US005911807A

United States Patent [19]

Brooks et al.

[11] Patent Number: 5,911,807

[45] Date of Patent: Jun. 15, 1999

[54] APPARATUS FOR CUTTING A CONTINUOUSLY FLOWING MATERIAL WEB

[75] Inventors: Jeffrey B. Brooks, Keene; Jason W. Dean, Peterborough; David A. Kearney, Keene; Jonathan P. Oakes, West Swanzey, all of N.H.

[73] Assignee: Markem Corporation, Keene, N.H.

[21] Appl. No.: 08/771,974

[22] Filed: Dec. 23, 1996

Related U.S. Application Data

[63] Continuation-in-part of application No. 08/720,421, Sep. 27, 1996.

[51] Int. Cl.[6] ..... B26D 5/20

[52] U.S. Cl. ..... 83/262; 83/236; 83/752; 83/577; 83/586; 83/698.21

[58] Field of Search ..... 83/263, 575, 581.1, 83/586, 587, 223, 248, 262, 386, 387, 948, 752, 456, 459, 460, 698.21, 567, 577; 318/159, 160; 310/36, 37; 361/206; 335/272, 228

[56] References Cited

U.S. PATENT DOCUMENTS

| | | | |
|---|---|---|---|
| 2,249,575 | 7/1941 | O'Brien et al. | 83/575 X |
| 2,831,355 | 4/1958 | Zimmerman | 83/575 X |
| 2,963,177 | 12/1960 | Shields | 414/790.3 |
| 3,055,250 | 9/1962 | Hubbard | 83/575 X |
| 3,080,784 | 3/1963 | Schneider | 83/698.21 X |
| 3,180,193 | 4/1965 | Benedict et al. | 83/586 X |
| 3,396,966 | 8/1968 | Solheim | 271/212 |
| 3,476,043 | 11/1969 | Erdley | 83/575 X |
| 3,640,438 | 2/1972 | Morse et al. | 226/25 |
| 3,692,304 | 9/1972 | de Ridder | 271/188 |
| 3,743,153 | 7/1973 | Moss | 226/91 |
| 3,744,649 | 7/1973 | Ward, Jr. | 414/788.7 |
| 3,768,349 | 10/1973 | Cauffiel | 83/42 |
| 3,855,891 | 12/1974 | Young | 83/575 X |
| 3,866,765 | 2/1975 | Stobb | 414/788.8 |
| 3,882,744 | 5/1975 | McCarroll | 83/262 |
| 4,007,656 | 2/1977 | Erdody et al. | 83/236 X |
| 4,067,568 | 1/1978 | Irvine | 271/176 |
| 4,219,825 | 8/1980 | Heyraud et al. | 335/272 X |
| 4,285,511 | 8/1981 | Abe | 271/178 |
| 4,353,274 | 10/1982 | Shimizu | 83/156 |
| 4,398,441 | 8/1983 | Jue | 83/575 |
| 4,429,602 | 2/1984 | Vits | 83/24 |
| 4,470,030 | 9/1984 | Myers | 335/228 |
| 4,517,538 | 5/1985 | Bohg et al. | 335/272 |
| 4,522,617 | 6/1985 | Mowry | 493/126 |
| 4,982,636 | 1/1991 | Becking | 83/167 |
| 5,079,980 | 1/1992 | Oakes et al. | 83/19 |
| 5,207,418 | 5/1993 | Oakes et al. | 271/212 |
| 5,337,030 | 8/1994 | Mohler | 310/36 X |
| 5,398,013 | 3/1995 | Suzuki et al. | 335/272 |

FOREIGN PATENT DOCUMENTS

| | | | |
|---|---|---|---|
| 46710/72 | 3/1969 | Japan | 83/575 |
| 1344529 | 10/1987 | U.S.S.R. | 83/575 |

OTHER PUBLICATIONS

Excerpts from Markem Model 655 Machine Manual.
Markem TA755i/56i Sales Brochure.
Excerpts from Markem Model 445DZ Machine Manual.

*Primary Examiner*—M. Rachuba
*Assistant Examiner*—Charles Goodman
*Attorney, Agent, or Firm*—Fish & Richardson P.C.

[57] ABSTRACT

Improvements are provided to improve an apparatus and method for processing a substantially constant velocity flow of a web of material, including a cutting mechanism and a web accumulator upstream of the cutter. The improvements include stopping the web by a side surface of the movable blade and configuring the accumulator dimensions and cutting speed to cause an appropriate level of force between the upstream severed end of the web and the blade. Several features achieve a low cutting time and modify cutting force to cut web regions with different characteristics, such as for cutting through splices. A low inertia rotary solenoid accelerates a blade through the web and against a resilient stop. The blade bounces off of the stop to its spring-biased home position. A permanent magnet or electromagnet holds the blade in the home position as solenoid current develops. These features result in reduced noise and shorter cutting time, thereby allowing an increase in web speed.

15 Claims, 9 Drawing Sheets

APPARATUS FOR CUTTING A CONTINUOUSLY FLOWING MATERIAL WEB

CROSS REFERENCE TO RELATED APPLICATIONS

This is a continuation-in-part of application Ser. No. 08/720,421 filed Sep. 27, 1996, which is hereby incorporated by reference as if fully set forth.

BACKGROUND OF THE INVENTION

The invention relates generally to the field of material processing, and more particularly to the printing and repeated cutting of a continuously flowing supply of material such as a fabric or paper web.

High speed printing and cutting machines are used to print upon and cut equal lengths of material from a continuous spool, such as in the production of manufacturers' labels to be placed in garments. The lengths of the labels must be consistent, and economic considerations make it desirable to produce many labels as quickly as possible.

Such a machine is described by Oakes et al. in U.S. Pat. No. 5,079,980, incorporated herein by reference, which processes a spool of fabric tape to produce discrete printed labels. During each cutting cycle, the flow of the tape immediately upstream of the cutter is momentarily halted by a brake. Thus halted, the tape can be cut cleanly and evenly, maintaining a fixed label length.

This machine has enjoyed considerable commercial success, producing high quality labels for use in the garment industry. Therefore improvements in the construction and operation of this type of machine and of printing machines incorporating such apparatus can be very advantageous.

SUMMARY OF THE INVENTION

In one aspect of the invention, improvements are provided to an apparatus for accommodating a substantially constant velocity flow of a material web to be processed at a downstream position of a web processing device, the apparatus including a substantially flat support base, a spring member, preferably a deformable plate member, positioned generally parallel to the support base and configured to be displaceable along its length by the material web, a web drive system for driving the web at a substantially constant velocity between the support base and the spring, and a means of stopping the flow of the web downstream of the support base and the spring, to cause buckling of the web between the support base and the spring and displacement of spring means to an expanded position, the release of the stopping means being operable in combination with the expanded spring to unbuckle the web and accelerate the web in a downstream direction away from the support base.

These improvements employ a movable blade to periodically cut the web, the improvements comprising stopping the web by a braking surface defined by a side surface of the movable blade exposed to be engaged by the forwardly directed, severed edge of the web.

According to another aspect of the invention, an apparatus for accommodating a substantially constant velocity flow of a material web and repeatedly cutting the web to a selected length is provided, the apparatus comprising a movable shear blade arranged to cut the web, the blade including a brake surface exposed to be engaged by the upstream severed edge of the web to halt the advance of the web during each cut, and an accumulator between the shear blade and an upstream web drive device. The accumulator comprises at least one resilient surface arranged to engage the accumulated web while the web flow is halted by the movable shear blade during each cut, as well as promote acceleration of the web following each cut.

Preferred embodiments of the above aspects of the invention employ one or more of the following features.

The accumulator has a length at least about 0.7 times the rate of advance of the web per second, in advantageous embodiments the rate of advance including a rate between about 7 and 10 inches per second.

The actuator system is capable of moving the shear blade into and out of contact with the web in less than about 15 milliseconds, effectively limiting the time for the accumulation of the web and the forward thrust exerted by the accumulated web against the blade.

The velocity of the web, the contact time of the blade with the web, and the length of the accumulator are selected to cause a length of web about 2 percent longer than the length of the accumulator to be disposed within the accumulator when the blade disengages the web.

The shear blade is connected to be driven by a solenoid toward a resilient stop positioned to decelerate the forward cutting motion of the arm.

In another aspect of the invention, the shear blade is mounted to pivot on a shaft and is operable by a rotary solenoid having a rotor comprising a shaft and a thin wafer portion, effective to provide low rotary inertia.

In another aspect of the invention, a magnet is positioned to temporarily retain a shear blade in a retracted position against a fixed stop upon energization of a blade-driving solenoid, thereby enabling the development of solenoid forces prior to blade movement.

In another aspect of the invention, in conjunction with a rotary drive solenoid for driving a shear blade, a return spring assists in the return of the shear blade to a predetermined, retracted position against a fixed stop, from which another cycle of operation can be predictably initiated.

Another aspect of the invention is a label printer machine that includes an apparatus according to any of the aspects of the invention previously described, a print head and tape drive arranged to feed printed web material to the apparatus.

According to another aspect of the invention, reduction in the noise generated by operation is achieved with the machine and method described, especially in which metal-to-metal impacts of moving parts are substantially avoided and resilient members are employed in conjunction with rotary actuation of the cutter.

According to another aspect of the invention, a method on improvement is made in the method for allowing a substantially uniform velocity flow of a material web to be processed in a web processing device having a substantially flat web support base and a spring assembly having a resilient plate member positioned generally parallel to the support base, the method comprising the steps of receiving the web between the support base and the plate member, stopping the web flow by engaging the web at a downstream end of the support base, thereby causing the web to deform the overlying plate member so as to form a buckled portion of web material between the support base and the plate member, releasing the web and depressing the buckled web portion with the plate member so as to accelerate the buckled web portion downstream from the plate member.

The improvement to this method employs a movable blade moved periodically to cut the web, the improvement comprising braking the web by exposing a side surface of the blade to the forwardly directed, severed edge of the web as the web is being cut, and the web being released by removing the blade from the web.

In some preferred embodiments of the method of the invention, the web is driven at a constant velocity, preferably of the order of 8 inches per second or higher, and the blade is driven to complete each cutting and return action for a duration less than about 15 milliseconds, preferably less than about 10 milliseconds or lower, preventing accumulation of the web to a degree that causes detrimental forces to be applied by the web to the side surface of the blade that can cause jamming.

According to another aspect of the invention, an apparatus for accommodating a substantially constant flow of a web of material and repeatedly cutting the web to a selected length comprises (1) a movable shear blade arranged to cut the web, (2) an accumulator between the shear blade and an upstream web drive device, (3) an actuator system capable of moving the shear blade into and out of contact with the web, and (4) a controller constructed and arranged to generate control signals of differing values for dynamically controlling the actuator system.

In preferred embodiments, the control signal comprises control pulses sent at determined time intervals to control the actuator system. In a particularly useful configuration, the control signal comprises energizing pulses and the controller modulates the width of the pulses to control the amount of energy applied by the actuator system to the blade.

In the present arrangement, the controller is arranged to send a first pulse to cut a first section of web, and a second pulse to cut a second section of web, the first pulse being wider than the second pulse and the first section of web being more cut-resistant than the second section of web.

In other embodiments, the apparatus comprises a sensor responsive to a characteristic of the approaching web material that affects the energy required to cut the web. In such embodiments the controller is constructed and arranged to modify the amount of energy applied by the actuator system to the blade as a function of the sensed characteristic. In some instances the sensor is a splice detector, with the controller being constructed and arranged to temporarily increase the amount of energy applied by the actuator system to the blade as a result of the detection by the sensor of a splice in the web.

In the present configuration, the sensor is a photoelectric sensor.

In the presently preferred embodiment, the actuator system includes a solenoid. The energy applied by the actuator system is modified by modifying the duration of a voltage pulse to the solenoid. In one embodiment, the solenoid is a rotary solenoid.

In certain advantageous arrangements, the sensor is responsive to changes in web thickness. In some cases, the sensor is a web capacitance sensor. In other cases, the sensor is a potentiometer with a movable element biased against the web, the web flowing between a support surface and the movable element. In yet other embodiments, the sensor has a beam of light, the beam being arranged to be reflected off of a surface of the web to determine web thickness.

In the present configuration, the sensor is adapted to respond to a splice which is thicker than an unspliced section of the web.

In some cases, the sensed characteristic is web width, with the sensor being constructed and arranged to sense the width of the web.

In the present embodiment, the web is advantageously braked by exposing a side surface of the blade to the forwardly directed, severed edge of the web as the web is being cut.

In certain configurations, the controller is adapted to generate two or more energizing pulses during a single cutting cycle. Advantageously, in some cases the apparatus is arranged such that at least one of the energizing pulses causes the shear blade to be decelerated.

In particularly useful arrangements, a label printer machine is provided, including a print head and tape drive arranged to feed printed web material to the apparatus. In some advantageous embodiments, the machine includes adjustment means which enables the amount of energy applied by the actuator system to the blade to be adjusted by a machine operator.

In some instances the machine has a user interface, enabling the operator to input web parameters affecting the energy required to effect a cut. The controller is arranged to determine the amount of energy to be applied by the actuator system to the blade as a function of the web parameters.

In another aspect of the invention, an apparatus is provided for accommodating a substantially constant velocity flow of a material web and repeatedly cutting the web to selected lengths, comprising (1) a movable shear blade arranged to cut the web, the shear blade being mounted on a pivotable arm, (2) an actuator system capable of moving the shear blade into and out of contact with the web in less than about 15 milliseconds, the actuator system comprising a rotary solenoid and a limit stop which limits the cutting motion of the blade, (3) a sensor responsive to a characteristic of the approaching web material that affects the energy required to cut the web, and (4) a controller constructed and arranged to modify the amount of energy applied by the actuator system to the blade as a function of the sensed characteristic.

According to another aspect of the invention, a method is provided for accommodating a substantially constant flow of a web of material having at least one characteristic that varies along its length, and repeatedly cutting the web to a selected length. The method comprises (1) driving the web, (2) sensing the characteristic of the approaching web material, and (3) activating an actuator system to move a shear blade periodically to cut the web in response to the sensed characteristic.

In certain advantageous embodiments, the web characteristic affects the amount of energy required to cut the web, and the energy applied by the actuator system is varied as a function of the characteristic.

In some embodiments the method of the present invention also comprises determining the amount of energy as a function of web parameters entered via a user interface.

In some cases the characteristic indicates the presence of a splice in the web. In some preferred configurations, the splice section is sensed optically.

In some cases the characteristic is web thickness. In other cases, the characteristic is web width.

DESCRIPTION OF THE PREFERRED EMBODIMENTS

Figure 1:
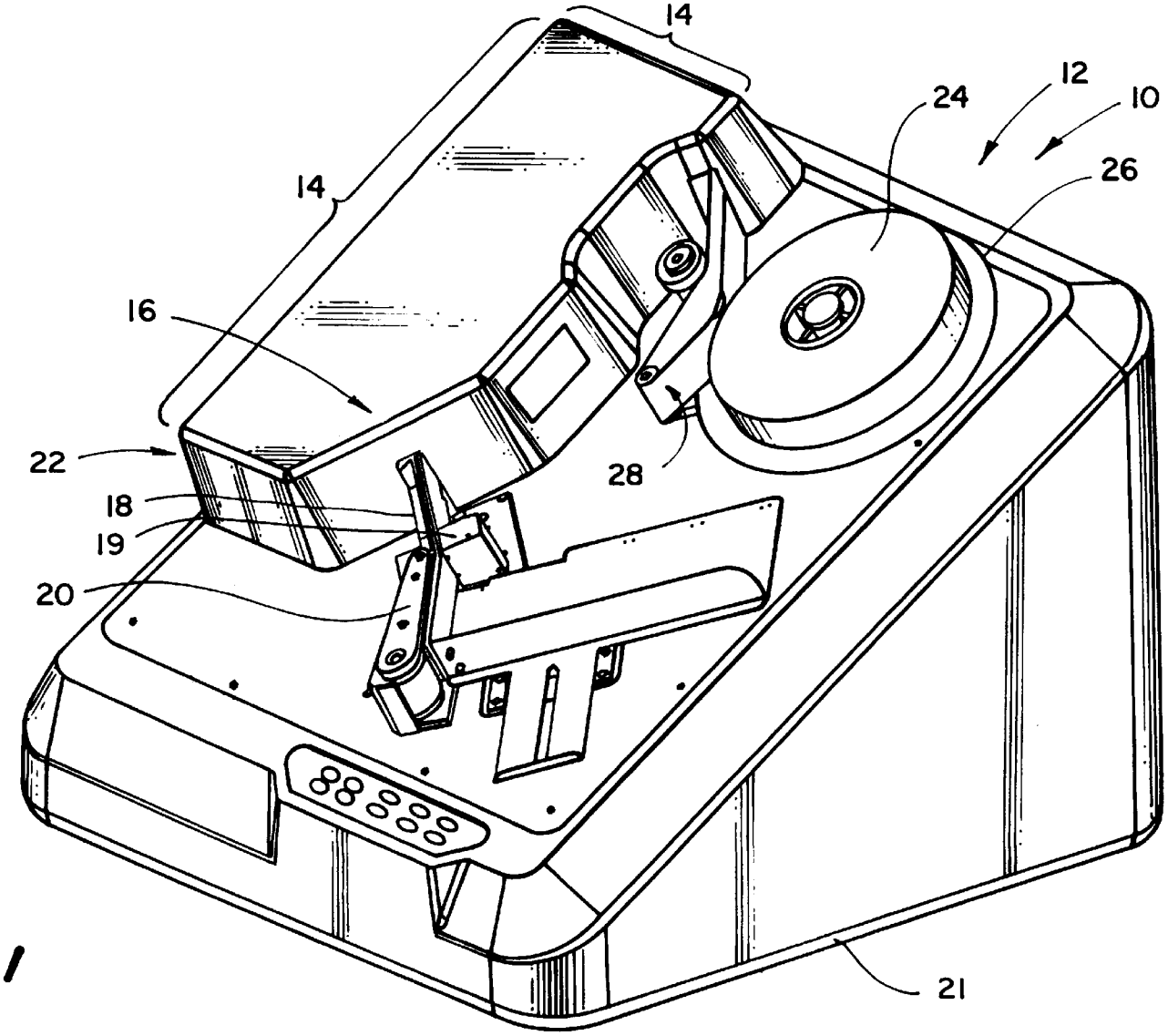
FIG. 1 is a perspective view of a printer, according to the invention.

With reference to FIG. 1, the label printer 10 is comprised generally of a fabric tape supply assembly 12, a tape printing assembly 14, a tape drive assembly 16 for advancing fabric tape from the tape supply assembly 12 through the printer, a tape accumulator assembly 18 for accommodating the flow of tape incident to tape cutting, a tape cutting assembly 19, and a stacking assembly 20 for collecting and stacking printed and cut labels that are produced by the label printer. All of the components of the printer are generally mounted to a machine base structure 21.

The tape supply assembly 12 is comprised of a supply reel of fabric tape 24 that is rotatably mounted to a support platter 26. The fabric tape is preferably a printable, coated polyester, acetate, poly-cotton blend, or nylon, and is wound about a roller 28 that is mounted to a dancer arm (not shown). Following its passage about the dancer arm roller 28, the tape 24 passes an encoder wheel (136, FIG. 12) and enters, in succession, the tape printing assembly 14, the tape drive assembly 16, the tape accumulator assembly 18, the tape cutting assembly 19, and the stacking assembly 20. In FIG. 1 the encoder wheel and component assemblies 14 and 16 are not shown, being located beneath protective cover 22.

Figure 2:
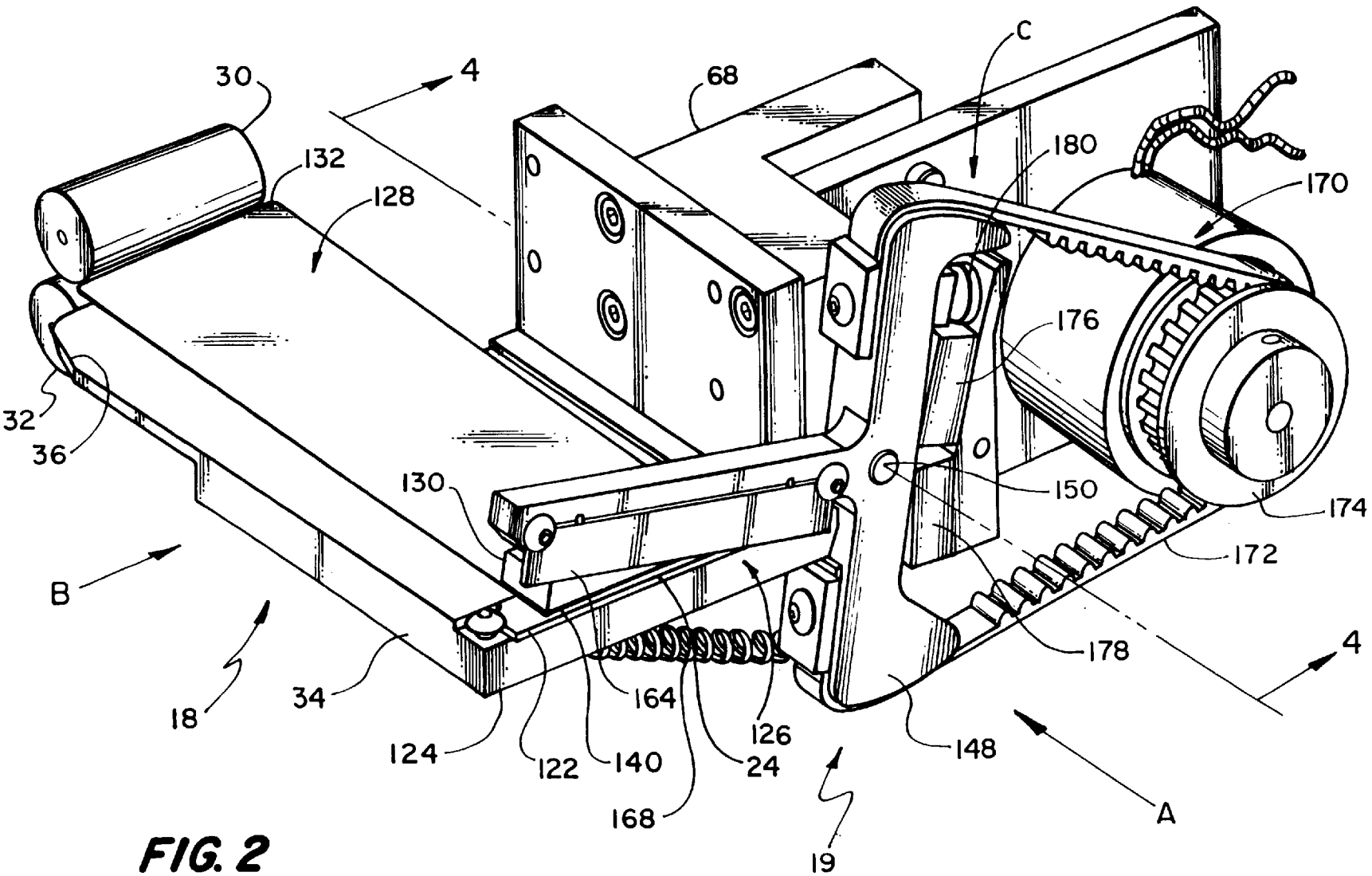
FIG. 2 is a perspective view of the cutting area of the printer.

FIG. 2 shows further details of the accumulator and cutter assemblies 18 and 19 of the printer. The accumulator assembly 18 is positioned downstream of the tape drive roller 30 and includes at its lower end a rigid support base 34 that is fixedly connected to base structure 21. As used throughout this disclosure, "downstream" relates to the direction of tape travel through the printer, whereas the term "upstream" refers to a direction opposite that of tape travel. The upstream end of the base 34 has a flange 36 that extends toward the drive and tension rollers 30 and 32, respectively, to facilitate passage of the tape 24 to the support base 34. A generally flat, sharp-edged cutting blade 122 is detachably mounted to the base 34 in a conventional manner. The blade extends beyond the downstream edge 124 of the base 34 and constitutes the lower half of a scissors cutter 126 for cutting tape 24 into a plurality of sections having a predetermined length.

Positioned above the support base 34 in a spaced, generally parallel relation therewith is a label spring 128. The label spring 128 is formed as a thin, planar strip of flexible material that is connected at its rigid downstream end to a spring mount 130 fixed to support base 34, and terminates at a free upstream end 132. The label spring 128 is spaced in relation to tape tension roller 32 such that the tape 24 is fed through a channel 140 between the label spring 128 and the support base 34. Label spring 128 is of sufficient length and flexibility to allow tape 24 to accumulate within expanding channel 140 while the flow of tape is stopped at the cutting assembly 19. The support base 34, the label spring 128, and channel 140 together form the accumulator assembly 18.

Figure 3:
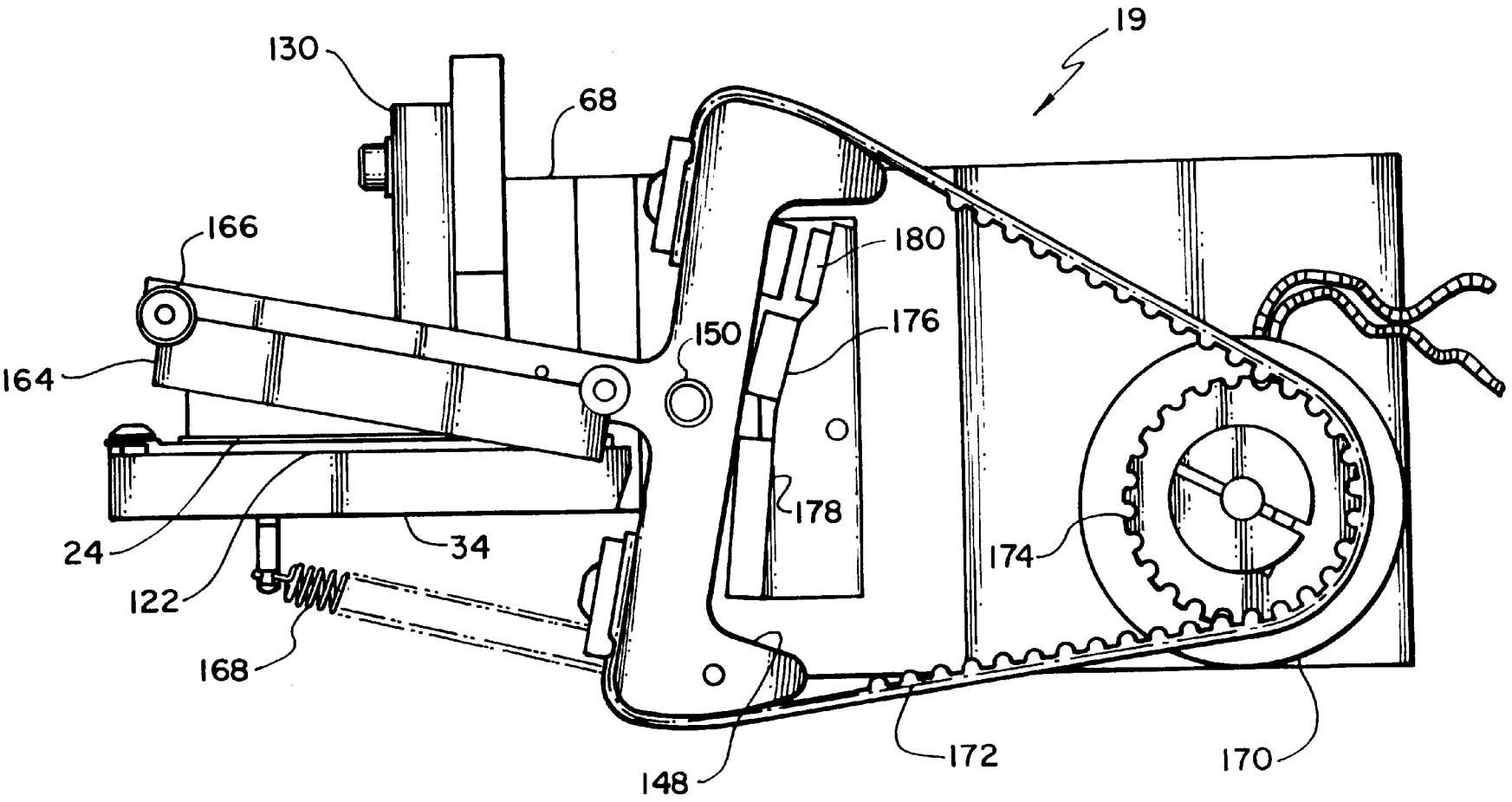
FIG. 3 is an end view of the cutting mechanism, as viewed from direction A in FIG. 2.
Figure 4:
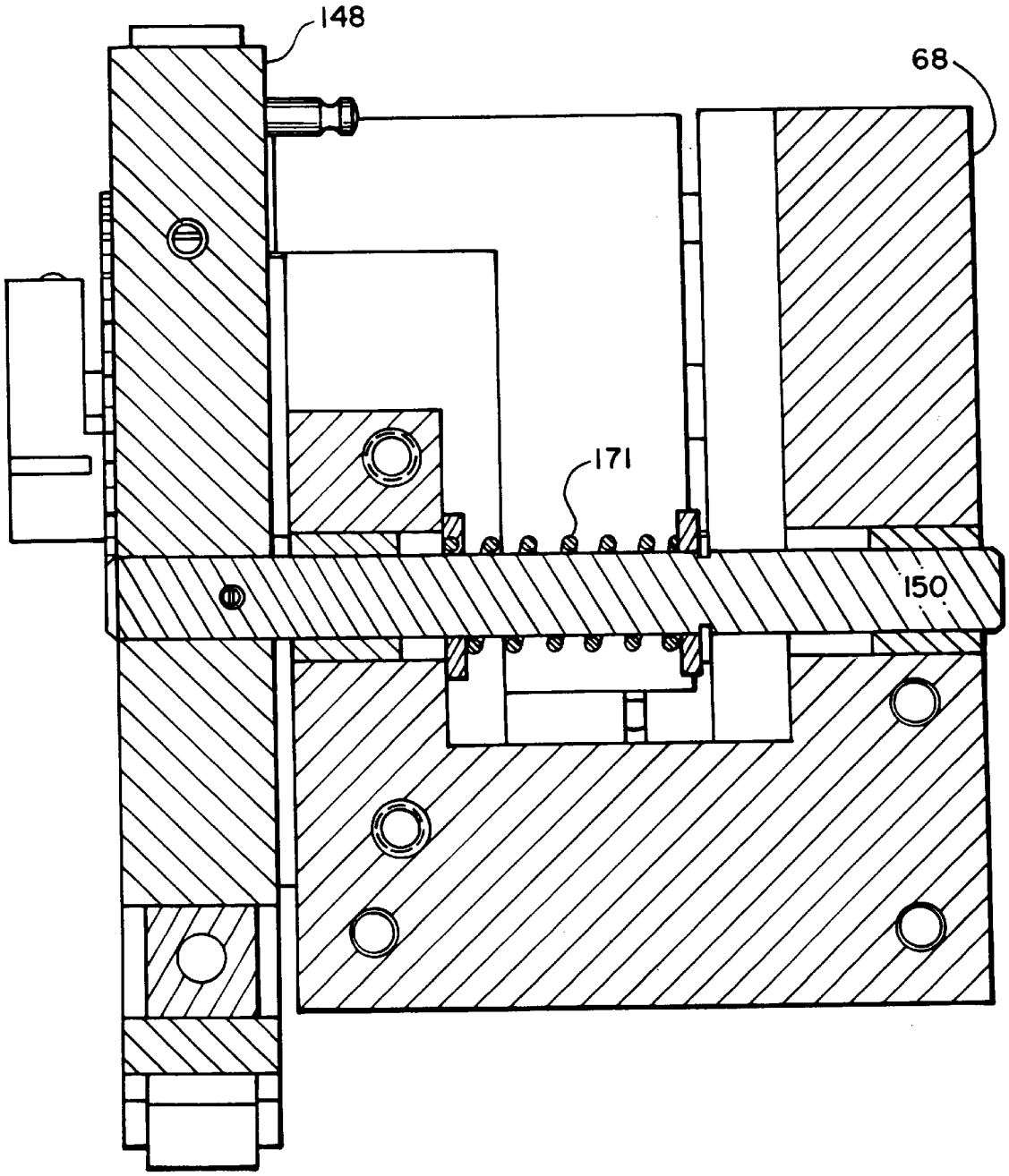
FIG. 4 is a sectional view, taken along line 4—4 in FIG. 2.
Figure 5:
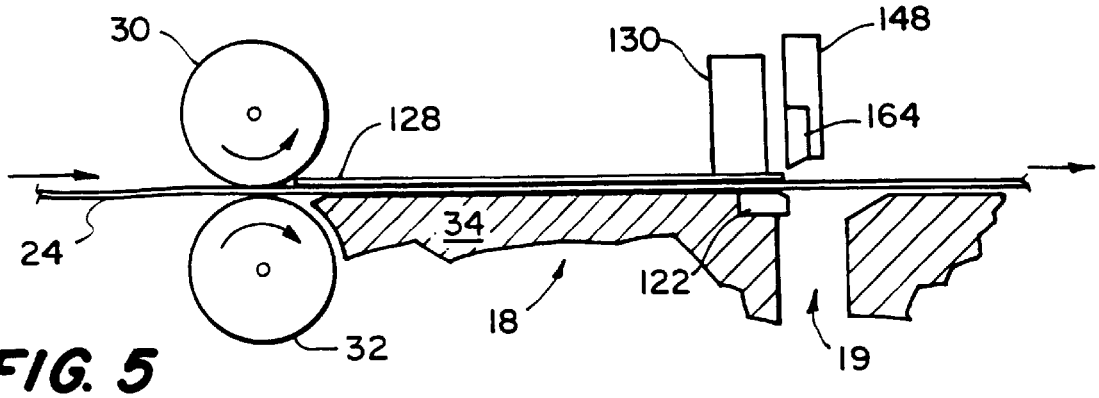
FIGS. 5–8 schematically illustrate the function of the web accumulator and cutting mechanism, as viewed from direction B in FIG. 2.
Figure 6:
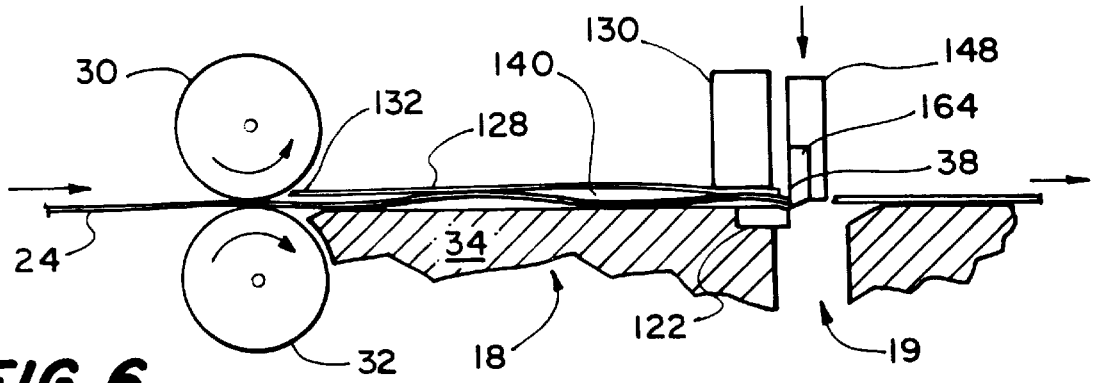

With reference to FIG. 3, the cutting assembly 19, positioned adjacent to the downstream end of the accumulator assembly 18, includes a generally T-shaped cutter arm 148 which is pivotably mounted to bearing block 68 through a shaft 150. Bearing block 68 is preferably adjustably mounted to machine base 21 to permit adjustment of the relative positions of the two cutting blades. The cutter blade 164 is preferably detachably mounted to the cutter arm 148 by conventional mechanical fasteners 166 to permit periodic cutter replacement. The cutter blades 122 and 164 are positioned relative to one another such that a portion of the tape 24 that is interposed between the respective blades can be severed from the web upon downward rotational displacement of the cutter arm 148. As seen in FIG. 4, an axial compression spring 171 about shaft 150 and bearing against a surface of bearing block 68 provides a force to keep cutter blades 122 and 164 in contact.

Figure 11:
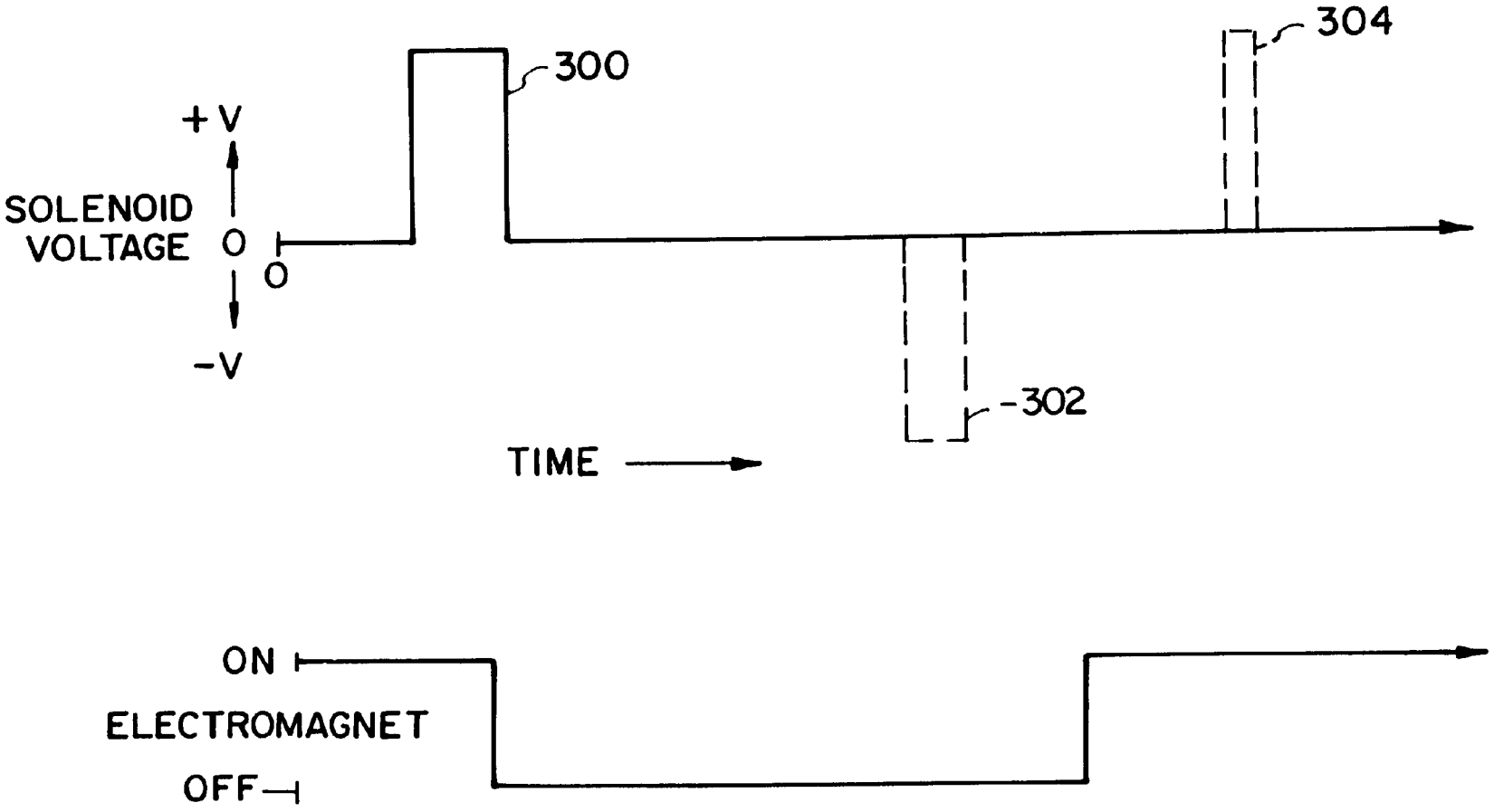
FIG. 11 is a timing diagram of the actuation of the cutting mechanism.

Referring back to FIG. 2, extension spring 168 is connected to cutter arm 148 and base 34 in such a way as to bias cutter arm 148 to the raised position as shown. Cutter arm 148 is accelerated downward about shaft 150 from a home position by a rotary solenoid 170, which is mounted to bearing block 68 and acts through toothed belt 172 by driving sprocket 174. Rotation of cutter arm 148 is limited in each direction at predetermined positions by resilient, sound-absorbing stops 176 and 178 mounted to bearing block 68. Torque is produced on driving sprocket 174 by a pulse of current applied to solenoid 170. This pulse is of appropriate duration to produce the desired acceleration of cutter arm 148, but is no longer than the time required for cutter arm 148 to reach its downward travel limit, e.g. stop 178. A typical timing diagram showing the pulse 300 of the solenoid in relation to the cutting cycle is shown in FIG. 11.

After blade 164 has cut tape 24, it continues in a downward direction until it strikes stop 178, at which point some of the kinetic energy of cutter arm 148 is temporarily stored in stop 178 and used to augment the energy stored in spring 168 to re-accelerate cutter arm 148 in an upward direction. This transfer of energy, or 'bounce', helps to reduce the length of time that blade 164 is in contact with tape 24.

In another preferred embodiment, a second voltage pulse 302, of opposite polarity to the pulse used to downwardly accelerate cutter arm 148, of limited duration may be used near the beginning of the upward motion of the cutter arm to increase the upward acceleration of the arm and reduce the cycle time of the cutting mechanism.

According to the invention, reduction in the noise generated by operation is achieved by using a portion of a flexible timing belt 172 to couple solenoid 170 to cutter arm 148, thereby avoiding metal-to-metal impacts of moving parts. This noise reduction is further enhanced with the use of resilient materials for stops 176 and 178.

According to the invention, further reduction in airborne noise is achieved in another embodiment in which an accurately timed, relatively small pulse 304 of voltage, of a polarity so as to cause a downward acceleration of cutter arm 148, is applied to solenoid 170 just before the cutter arm strikes the upper stop 176, thereby reducing the airborne noise caused by the contact between the cutter arm and stop 176.

In order to increase the acceleration of downward stroke of cutter arm 148 upon actuation, in certain preferred embodiments a permanent magnet 180 is mounted to bearing block 68 to provide an attractive force tending to maintain cutter arm 148 against upper stop 176. In this embodiment, cutter arm 148 does not begin its downward stroke until the driving force of solenoid 170 has built up after actuation to be sufficient to overcome the preload of extension spring 168 and the attractive force of magnet 180. At this point the growing air gap between cutter arm 148 and magnet 180 causes a rapid decrease in the magnetic attractive force, thus making available all of the torque present from the solenoid to accelerate cutter arm 148. This results in a faster acceleration of cutter arm 148 during its motion.

Figure 9:
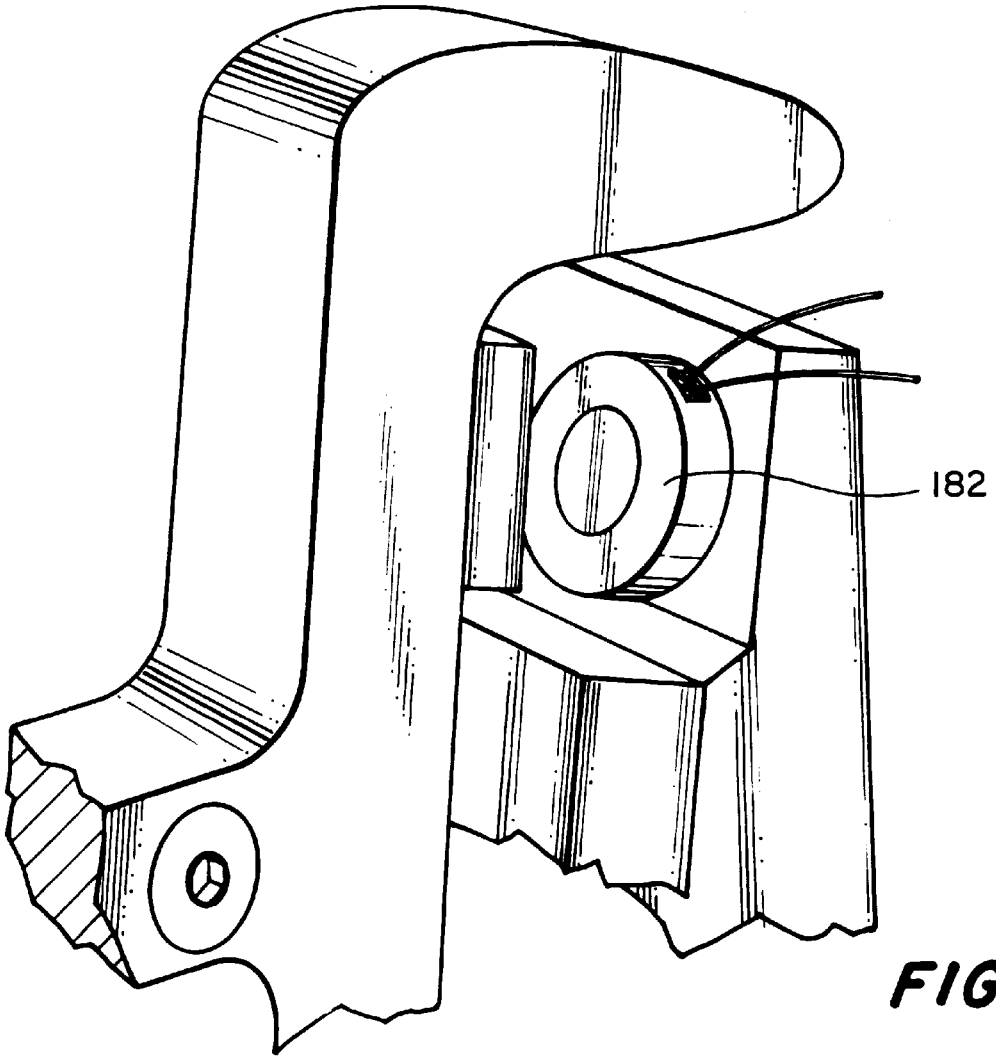
FIG. 9 is an enlargement of area C in FIG. 2, showing another embodiment of the invention.

As shown in FIG. 9, an electromagnet 182 is used in another preferred embodiment, in place of permanent magnet 180, to provide the magnetic attractive force. In this case the de-energization of electromagnet 182 may be accurately timed with relation to the activation of solenoid 170 to optimize the downward acceleration of cutter arm 148, as shown in FIG. 11.

FIGS. 5 through 8 sequentially illustrate the operation of the accumulator assembly 18 and the cutting assembly 19. Before blade 164 engages tape 24 (FIG. 5), tape 24 is moving through the cutting assembly 19 generally at a constant velocity corresponding to the surface speed of drive roller 30. At this point in the cutting cycle spring 128 and tape 24 are generally flat within accumulator assembly 18.

Blade 164 has a surface 38 directed upstream that is exposed to be engaged by the severed edge of tape 24 as it is cut. Particularly with the characteristics of the accumulator and the high speed characteristics of the solenoid activation, more fully described below, the blade itself is able to act as a brake for the printed fabric tape.

As blade 164 begins to contact tape 24 (FIG. 6), the flow of the tape is effectively stopped in the cutting assembly 19 by the normal force of the tape 24 against blade surface 38. Because drive roller 30 continues to propel tape 24 into accumulator assembly 18 during this sequence, tape 24 begins to buckle within accumulator assembly 18, pushing spring 128 away from base 34. As free end 132 of spring 128 is constrained against significant upward motion by roller 30, spring 128 begins to arch away from base 34 by the continued accumulation of tape 24, expanding channel 140. Spring 128 thus resiliently resists the buckling of the tape.

Figure 7:
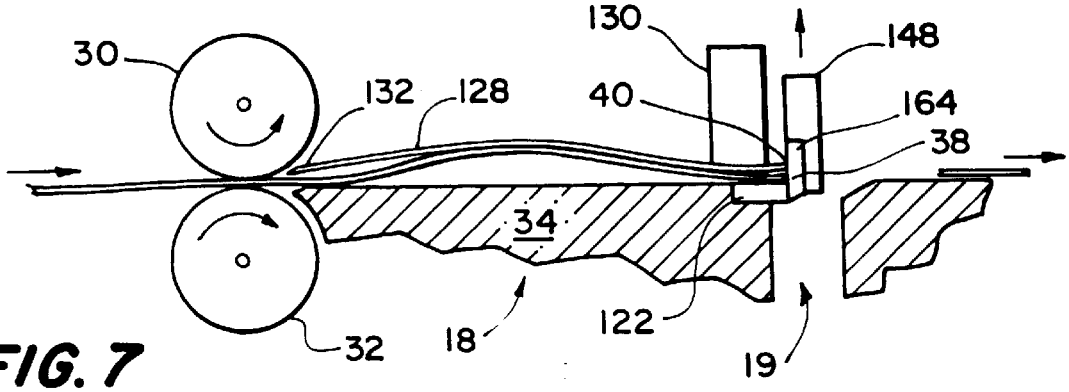
Figure 8:
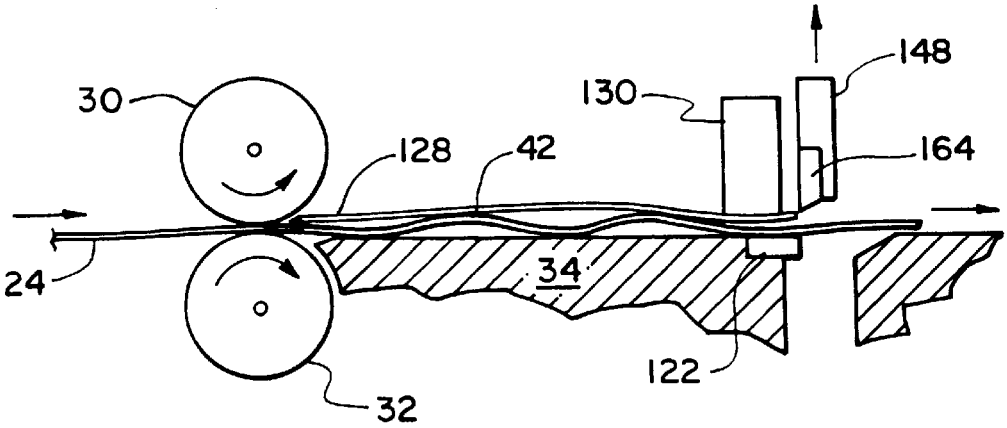

As blade cutter arm 148 continues through its cutting and return motions, surface 38 effectively brakes the tape 24, and the tape continues to accumulate in accumulating assembly 18 as long as blade 164 is in contact with the tape (FIG. 7). During this time, spring 128 continues to be arched upward by the force of the accumulating tape 24. The normal force between the severed end 40 of tape 24 and surface 38 of blade 164 continues to increase, due to the increasing columnar compression of tape 24 within the accumulator assembly.

When the continued motion of blade 164 causes blade surface 38 to quit contact with severed tape end 40 (FIG. 8) stored energy in accumulated tape 42 and spring 128 causes tape end 40 to thrust forward through cutting assembly 19 at a speed somewhat faster than the forward motion of tape 24 at drive roller 30. This speed differential continues until spring 128 has returned to a substantially relaxed state, and tape end 40 is again moving at the velocity of the drive roller.

According to the invention, we have realized that if the normal force that develops between tape end 40 and blade surface 38 becomes too large, a part of tape end 40 will have a tendency to fold against blade surface 38 and jam the machine, while, on the other hand, if this normal force remains small, forward thrust of the freed tape may be insufficient to overcome friction within accumulator assembly 18, the tape may not regain the constant velocity in a predictable manner, and registration with the printed matter may be lost. If the normal force is small enough, the machine may jam.

The accumulator assembly 18 and cutting assembly 19 are constructed and arranged such that a desirable amount of normal force consistently develops between tape end 40 and blade surface 38. This force is a function of the contact time of the blade 164 with the web (t), the velocity of the web (v), the stiffness of spring 128 (k), the length of the accumulator (L), and the friction coefficient between tape 24 and spring 128 (f). We have found that a spring 128 made of spring steel stock about 0.010 inch thick and about 6 inches long will appropriately limit this force when the contact time (t) is kept below about 15 milliseconds, up to a tape velocity (v) of about 8 inches per second for fabric tape thicknesses of about 0.004 inch. These parameters may vary complementarily from those values disclosed herein and still fall within the scope of the invention, so long as the resulting contact force between tape end 40 and blade surface 38 is maintained low enough to prevent tape end 40 to fold and high enough to achieve proper acceleration.

Figure 10:
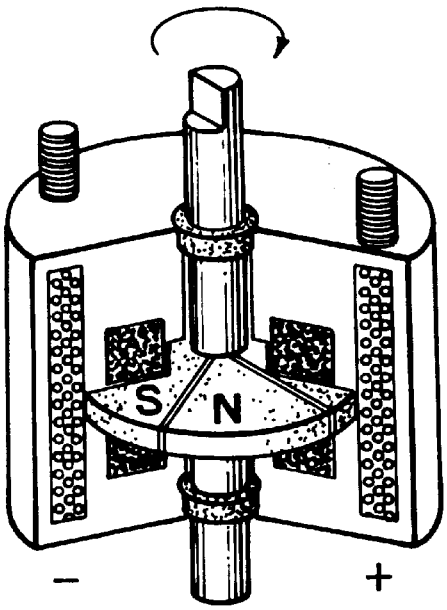
FIG. 10 is a cutaway view of a rotary solenoid used to advantage in embodiments of the invention.

In order to achieve a contact time (t) of less than about 15 milliseconds, we have realized that it is highly preferable that the inertia of the moving portion of cutting assembly 19, including the inertia of the spool of solenoid 170, be small. We have found that a Lucas Ultimag Model 194644-023 solenoid has sufficiently low inertia and fast response time to result in a cutting time t of less than 10 milliseconds. As seen in FIG. 10, solenoid rotor 44 includes only a thin magnetic wafer portion 46 attached to rotor shaft 48, resulting in a rotor with low resistance to angular acceleration (inertia). To further minimize cutter inertia, the cutter arm 148 is made of lightweight metal.

In other embodiments that take advantage of certain features of the invention, other specific structures are employed. For instance, a resilient pillow or pneumatic arrangement may serve to effectively confine the accumulated web and resist buckling. One or a plurality of low inertia linear actuators may be employed to pivot the blade, or the blade may be mounted to translate across the web path under conditions that enable the exposed brake surface of the blade to brake the printed tape.

Figure 12:
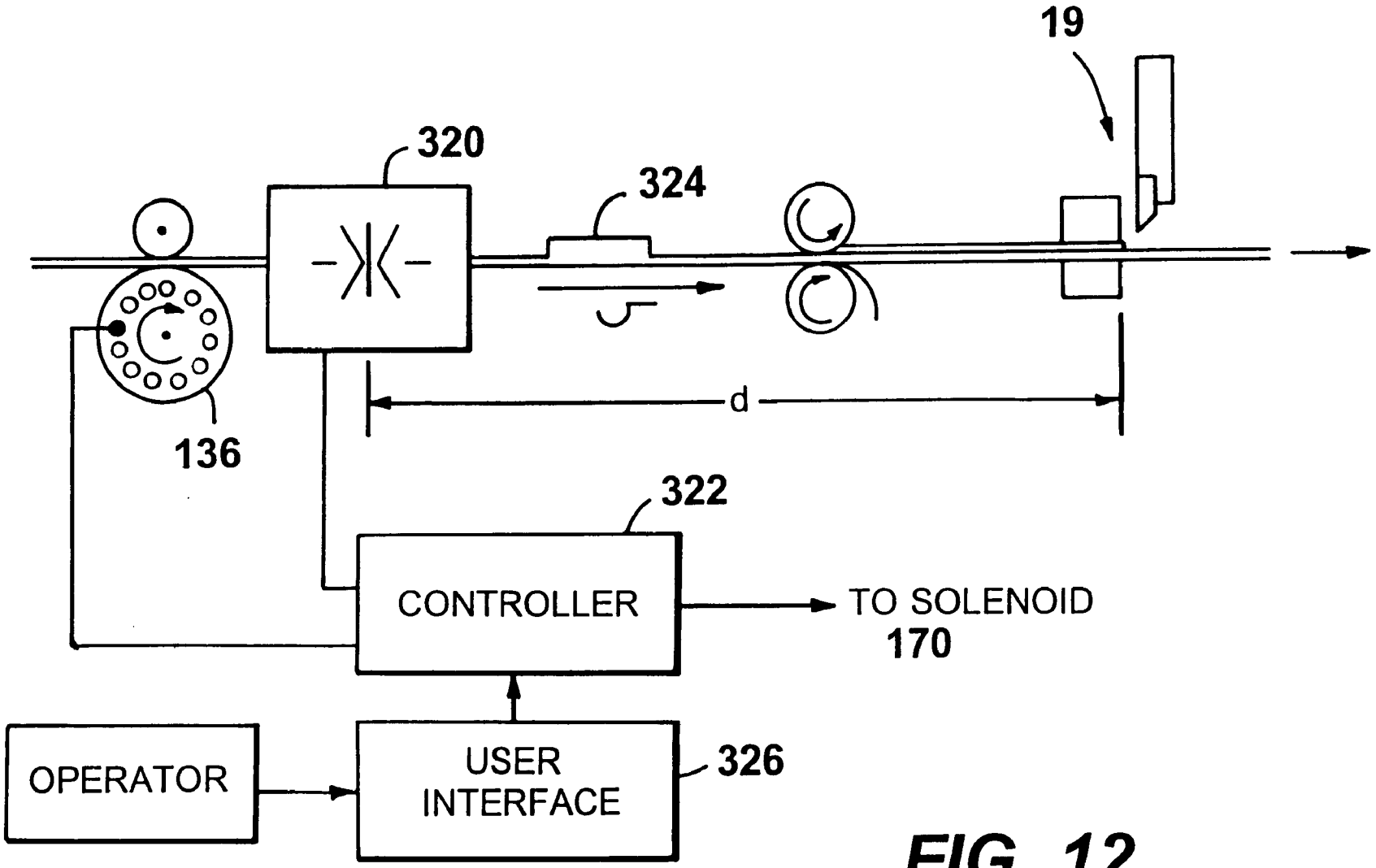
FIG. 12 is a schematic illustration of a preferred embodiment of a control system.

Referring to FIG. 12, in certain advantageous embodiments a sensor 320 is positioned upstream of the accumulator to sense a characteristic indicative of the cutting resistance of the web, e.g. web thickness, width, or the presence of a splice. In the embodiment shown, sensor 320 is constructed to respond to the presence of a splice 324 in the approaching web material. A controller 322 calculates the arrival time of the splice at cutting assembly 19 (e.g. by considering the tape velocity, V, as determined from information received from encoder 136 and the distance d between sensor 320 and cutting assembly 19) and modulates a control signal to dynamically vary the energy of the cut.

Figure 13:
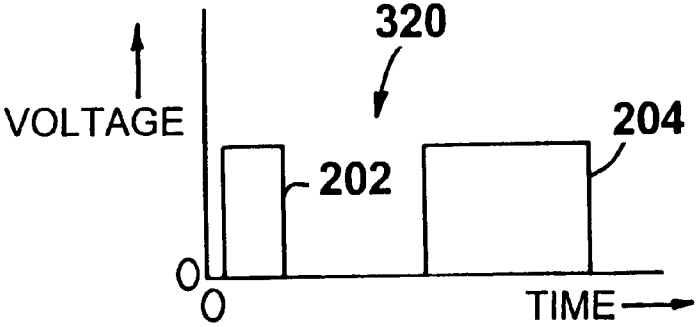
FIG. 13 illustrates a control signal generated by the controller in FIG. 12.

Referring also to FIG. 13, the control signal 200 sent by controller 322 to the solenoid of the actuator system (i.e. 170, FIG. 3) is made up of a series of voltage pulses of different durations. The amount of energy applied by the solenoid to drive the blade to cut the web is determined by the duration of the pulse, with longer pulses producing larger cutting forces. For instance, in one configuration a short pulse 202 (e.g. 0.003 seconds in duration) is generated by controller 322 to cut an unspliced section of web (of, e.g., 0.004 inch thickness), while a long pulse 204 (e.g. 0.010 seconds in duration) is generated to provide sufficient blade acceleration to cut through a splice (of, e.g., 0.011 inch thickness).

This energy modulation effectively extends the life of the replaceable stops by applying only the energy required to efficiently cut the web, thereby reducing the average residual impact energy applied by the cutter arm to the stops. Airborne noise is also reduced by thus reducing the impact energy of the arm against the stops.

In the presently preferred embodiment, sensor 320 is a photoelectric sensor, e.g. an infrared (IR) sensor. In other embodiments, other types of sensors are employed to detect other characteristics of the web that affect the energy required to cut the web. An IR sensor is employed, in some situations, to sense other visual characteristics of the web that are indicative of the cutting resistance of the web, such as material type or surface reflectivity. In another embodiment, sensor 320 is a web capacitance sensor.

Figure 14:
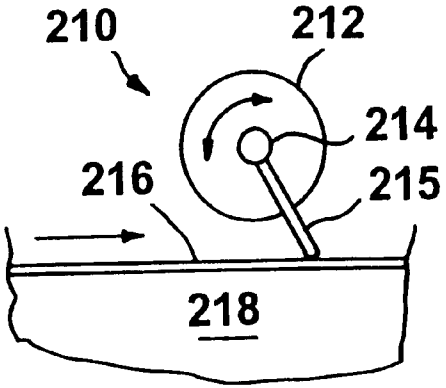
FIGS. 14 and 15 illustrate sensors of other embodiments.

Referring to FIG. 14, a web thickness sensor 210 in another embodiment of the invention comprises a rotary potentiometer 212 with a shaft 214 having a radial extension 215 which is rotationally biased by a spring (not shown) against a surface 216 of the web, which flows between potentiometer 212 and a support surface 218. Variations in the thickness of the web cause variations in the rotational orientation of the potentiometer, which are detectable by the controller as variations in the resistance of sensor 210.

Figure 15:
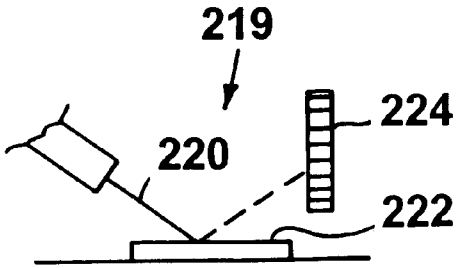

Referring to FIG. 15, in another embodiment of the invention a web thickness sensor 219 comprises a beam 220 of light which is reflected off of the surface 222 of the moving web and onto an array 224 of optical sensors, e.g. a CCD array. Variations in the thickness of the web cause the reflected beam of light to impinge upon different sensors within array 224, providing an indication of the thickness of the moving web.

Referring back to FIG. 12, in other embodiments the energy applied to cut the web is adjustable by the operator. This adjustment allows the operator to adjust the cutting force of the blade for successful cutting of different tape widths and materials, as required, within the range of machine capabilities. In a preferred embodiment, a user interface 326 is adapted to receive a number of inputs to gather information on various web parameters from the operator in order to determine the duration of a pulse to be generated to cut a nominal section of web. In various configurations these web parameters include web type, web material, web thickness, and web width, among others. The controller 322 in certain embodiments includes a look up table and/or computational software that enables the optimum pulse length to be produced according to the input parameters and/or signals from sensors.

In still other embodiments the web material itself carries indicia, such as bar code encryptions, either directly defining the pulse length or providing certain parameters used as inputs by the controller to determine pulse length. In one configuration the speed of the web is dynamically varied based upon detected measurements of settings or indicia.

These and other features and advantages will be understood from the following claims taken in conjunction with the foregoing specification and accompanying drawings.

What is claimed is:

1. An apparatus for accommodating a substantially constant velocity flow of a material web and repeatedly cutting the web to a selected length, the apparatus comprising a movable shear blade arranged to cut the web, the blade including a brake surface exposed to locally halt advance of the web by engaging an upstream severed edge of the web during each cut, the web thereby being braked and cut at a common position along the web; and an accumulator disposed between the shear blade and an upstream web drive device and arranged to define a volume for accumulating the web during each cut, the accumulator comprising at least one resilient surface arranged to engage accumulated web while the web advance is halted by the shear blade during each cut, and promote acceleration of the web following each cut.

2. The apparatus of claim 1 comprising a solenoid arranged to drive the blade toward a stop.

3. The apparatus of claim 2 including a magnet positioned to temporarily retain the shear blade in a retracted position against a fixed stop during energization of said solenoid.

4. The apparatus of claim 2 in which the stop is resilient, the stop arranged to store energy while decelerating a forward cutting motion of the blade, and to subsequently accelerate the blade in a return motion.

5. The apparatus of claim 1 in which the shear blade is pivotably mounted upon a shaft, the apparatus comprising a rotary solenoid adapted to pivot the shear blade.

6. The apparatus of claim 5 in which the solenoid comprises a rotor having a shaft and a thin magnetic wafer portion.

7. An apparatus for accommodating a substantially constant velocity flow of a material web and repeatedly cutting the web to a selected length, the apparatus having a moving assembly comprising a movable shear blade arranged to cut the web, the blade including a brake surface exposed to locally halt advance of the web by engaging an upstream severed edge of the web during each cut, the web thereby being braked and cut at a common position along the web; and a solenoid mounted to accelerate the blade toward the web; and a magnet adapted to temporarily retain the moving assembly in a retracted position during energization of said solenoid, thereby enabling development of a force applied by the solenoid to the blade prior to substantial movement of the moving assembly.

8. The apparatus of claim 7 in which said solenoid comprises a rotary solenoid.

9. The apparatus of claim 1 or 2 including a return spring arranged to bias the shear blade toward a retracted position against a fixed stop.

10. The apparatus of claim 3 or 7 in which the magnet comprises a permanent magnet.

11. The apparatus of claim 3 or 7 in which the magnet comprises an electromagnet.

12. The apparatus of claim 11 including control means to de-energize the electromagnet to release the blade subsequent to actuation of the solenoid to apply said force to the blade.

13. An apparatus for accommodating a substantially constant velocity flow of a material web and repeatedly cutting the web to a selected length, the apparatus comprising a movable shear blade mounted on a pivotable arm and arranged to cut the web, the blade including a brake surface exposed to locally halt advance of the web by engaging an upstream severed edge of the web during each cut, the web thereby being braked and cut at a common position along the web;

an accumulator disposed between the shear blade and an upstream web drive device and arranged to define a volume for accumulating the web during each cut; and a rotary solenoid adapted to accelerate the blade toward the web, the solenoid comprising a rotor connected to the blade and having a shaft and a thin magnetic wafer portion, such that the solenoid has a low effective rotary inertia, such that the solenoid is adapted to move the shear blade into and out of contact with the web in less than about 15 milliseconds, effectively limiting accumulation of the web in the accumulator.

14. The apparatus of claim 13 including a portion of flexible timing belt arranged to connect the rotary solenoid to the pivotable arm.

15. An apparatus for cutting a flow of a material web, the apparatus comprising a movable shear blade arranged to cut the web, the blade including a brake surface exposed to temporarily and locally halt advance of the web by engaging an upstream severed edge of the web as the web is cut, the web thereby being braked and cut at a common position along the web; and an accumulator disposed between the shear blade and an upstream web drive device and arranged to define a volume for accumulating the web during each cut, the accumulator comprising a resilient surface arranged to be deflected by the accumulated web and to locally accelerate advance of the web following each cut.

* * * * *